US005520799A

United States Patent [19]

Brown et al.

[11] Patent Number: 5,520,799

[45] Date of Patent: May 28, 1996

[54] DISTILLATE UPGRADING PROCESS

[75] Inventors: Stephen H. Brown, Princeton, N.J.; Paul P. Durand, Wilmington, Del.; Timothy L. Hilbert, Sewell, N.J.; Thomas R. Kiliany, West Chester, Pa.; Chang-Kuei Lee, Sewell, N.J.; Jeffrey C. Trewella, Kennett Square, Pa.

[73] Assignee: Mobil Oil Corporation, Fairfax, Va.

[21] Appl. No.: 309,287

[22] Filed: Sep. 20, 1994

[51] Int. Cl.[6] ..... C10G 45/00; C10G 47/18

[52] U.S. Cl. ..... 208/143; 208/144; 208/216 R; 208/217; 208/251 H; 208/254 H; 208/227

[58] Field of Search ..... 208/144, 78, 80, 208/143, 216 R, 217, 251 H, 254 H, 227

[56] References Cited

U.S. PATENT DOCUMENTS

| | | | |
|---|---|---|---|
| 3,368,965 | 2/1968 | Schuman et al. | 208/143 |
| 3,900,388 | 8/1975 | Hilfman | 208/143 |
| 3,979,278 | 9/1976 | Hayes | 208/143 |
| 4,087,353 | 5/1978 | Rousch | 208/143 |
| 4,202,758 | 5/1980 | O'Hara | 208/143 |
| 5,147,526 | 9/1992 | Kukes et al. | 208/111 |
| 5,152,885 | 10/1992 | Singhal et al. | 208/254 |

*Primary Examiner*—Helane Myers
*Attorney, Agent, or Firm*—Alexander J. McKillop; Malcolm D. Keen; Penny L. Prater

[57] ABSTRACT

This invention is a process for the upgrading of distillate feeds. A batch of supported hydroprocessing catalyst is placed in a reaction zone, which is usually a fixed bed reactor. The hydroprocessing catalyst comprises an effective amount of a noble metal or metals and has a specific activity. Both low aromatic diesel and jet fuel may be produced in separate blocks over the same catalyst batch, using different feeds and often different conditions. The activity of the catalyst is restored each time the feed is switched. When production is switched from jet fuel to low aromatics diesel, activity may be regained more quickly by holding the catalyst at a higher temperature than the reaction temperature for a specific period of time prior to dropping the temperature to the reaction temperature. Switching from one feed to the other may continue for about one year before the catalyst batch is changed. A dual catalyst system may alternatively be employed. In this case a hydroprocessing catalyst batch comprising an effective amount of at least one base metal is used in combination with the catalyst comprising an effective amount of at least one noble metal catalyst. The feed contacts the catalyst comprising the base metal before it contacts the catalyst comprising a noble metal. In a dual catalyst system, the feeds may be switched for about two years over the two catalyst batches before fresh catalyst is necessary.

26 Claims, 4 Drawing Sheets

TARGET CONDITIONS FOR CONVERSION OF LOW HETEROATOM FEED TO LOW AROMATICS DIESEL IN FIXED REACTOR

TARGET CONDITIONS FOR CONVERSION OF HIGH HETEROATOM FEED TO JET FUEL IN FIXED BED REACTOR

LOADING OF FIXED BED REACTOR FOR BLOCK OPERATION USING A TWO CATALYST SYSTEM

AGING OF NOBLE METAL CATALYST IN BLOCK OPERATION

FIG. 3 RECOVERY RATE OF CATALYST ACTIVITY AS A FUNCTION OF TEMPERATURE AND DAYS ON STREAM
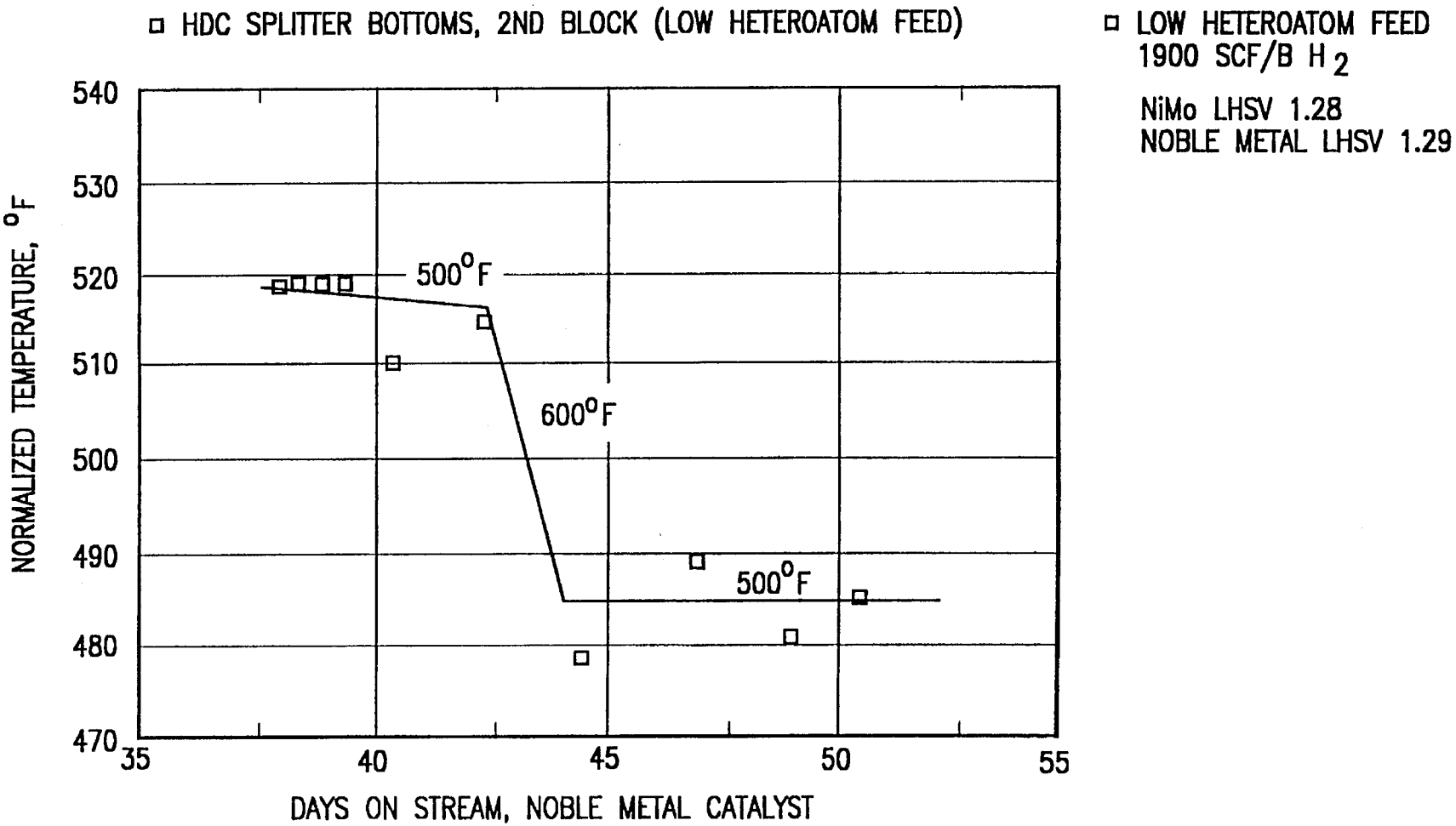

FIG. 4 AGING OF DUAL CATALYST SYSTEM IN BLOCK OPERATION
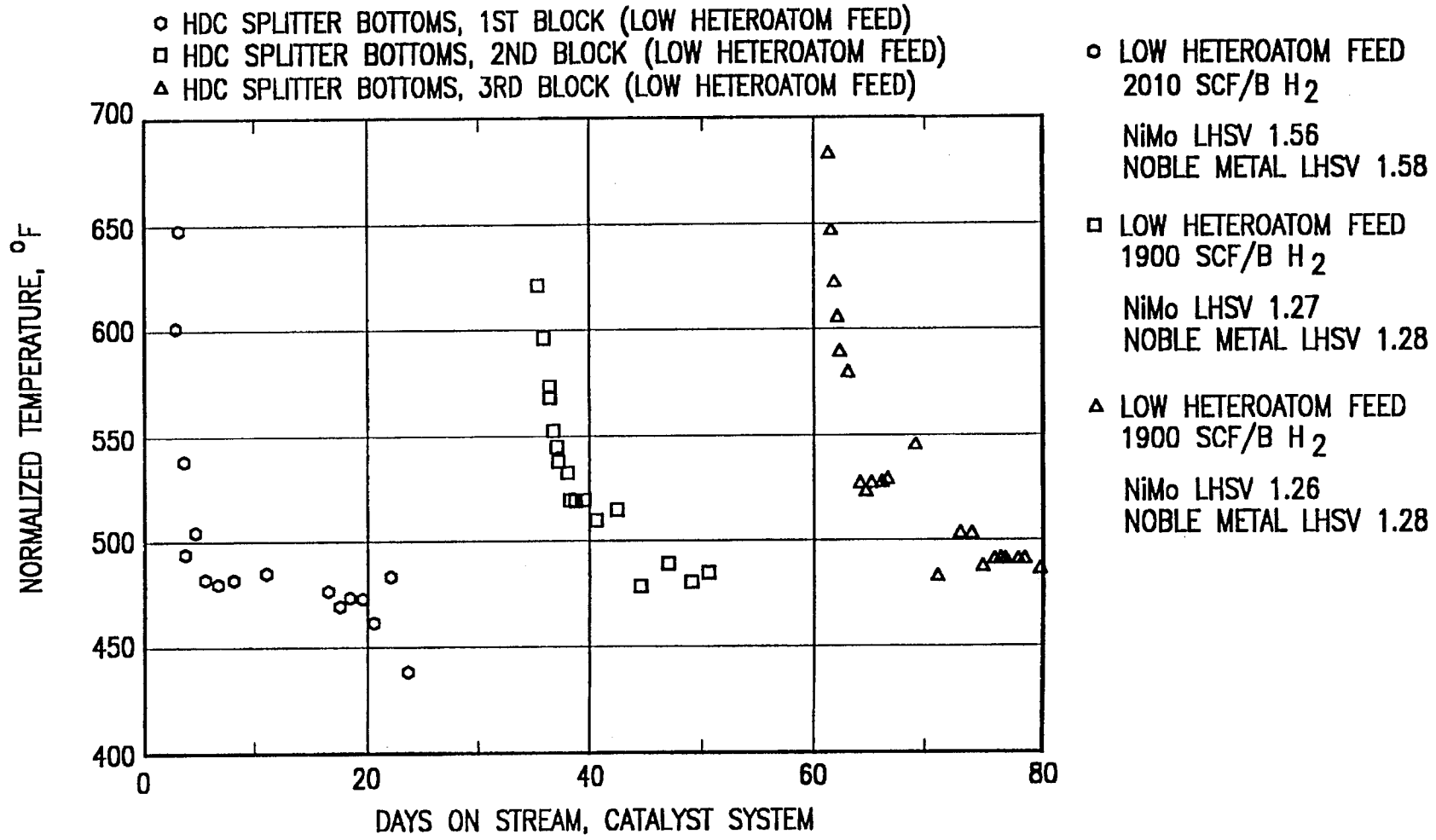

DISTILLATE UPGRADING PROCESS

FIELD OF THE INVENTION

This invention relates to a process for upgrading distillate feeds. Both kerosene type jet fuels and low aromatic diesel fuel may be produced in separate blocks over the same catalyst or dual catalyst system, thereby promoting unit flexibility. A feed of low heteroatom content is used to produce low aromatic diesel fuel, and a feed of high heteroatom content is used to produce jet fuel. Usually a single fixed bed reactor is used in this invention as the reaction zone. In some situations, particularly in the case of a two catalyst system, two or more reactors may be used.

BACKGROUND OF THE INVENTION

Hydrocarbon distillates vary widely in content. Some may contain a low percentage of non-metallic impurities and a high percentage of aromatic compounds, while others contain a low percentage of aromatics and a high percentage of non-metallic impurities such as nitrogen, sulfur and oxygen. Some distillates may contain varying percentages of both. These are often organic hydrocarbon compounds which contain these impurities as heteroatoms. Nonmetallic impurities adversely affect catalytic hydrocarbon processes such as hydrotreating by poisoning the catalyst. Distillates are hydrotreated for a variety of reasons. Hydrotreating maybe used to remove aromatics and other impurities. Environmental regulations in some areas of the United States currently require the aromatic content of diesel to be no more than 2 wt. %, preferably no more than 10 wt %.

Other distillates, such as those used for the production of kerosene jet fuel, are treated for the removal of heteroatoms. The same catalyst may be used for both aromatic removal and heteroatom removal, although in the past hydrotreating processes employing different feed compositions have been carried out in different reactors.

The concept of the instant invention involves switching back and forth, using the same catalyst or catalyst system, between low heteroatom content feeds, producing low aromatic diesel, and high heteroatom content feeds, producing jet fuel. By using the same catalyst batch in the same reaction zone, the refiner achieves desirable flexibility with reasonable cycle lengths.

The production of low aromatic diesel fuels is becoming increasingly important in both the United States and Europe. Catalysts impregnated with noble metals have been shown to be effective in saturating aromatic compounds. It has been observed (G. L. B. Thielemans, "Manufacturing of low aromatic diesel fuel," 1993 European Oil Refining Conference, 21–22 June 1993, Sitges, Barcelona) that the reduction of aromatic content via the hydrogenation process has a positive effect on all key fuel properties, although at high costs. Key fuel properties include cetane number and cetane index, as well as API gravity. Distillate aromatic content is inversely related to cetane number, the accepted measure of diesel fuel quality. Cetane number and cetane (or diesel) index are both measures of the ignition quality of diesel fuels. Diesel fuels have a minimum cetane number of 45.

Cetane number, which is directly related to ignition quality is highly dependent on the paraffinicity of molecular structures, whether they are straight-chain or alkyl attachments to rings. A distillate stream which comprises mostly aromatic rings with few or no alkyl-side chains generally is of low cetane quality while a highly paraffinic stream is generally of high cetane quality. Dearomatization of refinery distillate streams can increase the volume yield of distillate products. Aromatic distillate components are generally lower in gravity than their similarly boiling paraffinic counterparts. Saturation of aromatic rings can convert these lower API gravity aromatic components to higher API gravity saturated components and expand the volume yield of distillate product.

Hydroprocessing plants are expensive to construct as well as to operate, therefore those that are constructed must be designed for operation that is as efficient as possible.

Aromatic saturation activity is poisoned by even low heteroatom content feedstocks. Consequently, only very low heteroatom content feeds are traditionally fed to catalysts which saturate aromatics. Catalysts impregnated with noble metals can also remove heteroatoms, however. Low sulfur and nitrogen fuels can be produced from feedstocks which contain relatively high concentrations of heteroatoms, such as straight-run kerosene. Prior attempts have been made to deal with problems associated with the poisoning of hydroprocessing catalysts impregnated with metals and the subsequent decrease in their activity. U.S. Pat. No. 3,368,965 (Schuman) discloses the wetting of fresh catalyst by clean oil (non-aromatic oil of low coking tendency). The catalyst can then be heated along with regular heavy charge oil and hydrogen without forming much coke on its surface. The activity of the catalyst is thus improved. Although two different oils are being applied to the catalyst in this invention, only one is intended for conversion to product. One oil is applied to the catalyst only in a small amount as a wetting agent. Furthermore, these oils are not used alternately, in a swing fashion, as in the instant invention.

U.S. Pat. No. 3,900,388 (Hilfman) teaches the removal of aromatic impurities from paraffinic chargestocks. A catalyst which is surface-impregnated with Group VIII metals is contacted with the chargestock in an atmosphere comprising hydrogen. This chargestock has a very low aromatic content, i.e. 1.5 wt %, as opposed to the hydrocracker splitter bottoms or light gas oils of the instant invention, which contain over 30 wt % aromatic compounds. Unlike the present invention, removal of aromatics using the invention of this patent does not result in a higher volume of product.

U.S. Pat. No. 5,152,885 (Singhal et al.) discloses a hydrotreating process employing catalysts impregnated with noble metals and a ligand such as dithiocarbamate. In this process, heteroatoms may be removed from a variety of feeds, including distillates. There is no teaching of aromatics removal, however, or of switching different feeds over the same catalyst in order to restore catalyst activity, as in the instant invention.

U.S. Pat. No. 5,147,526 (Kukes et al.) and U.S. Pat. No. 5,151,172 (Kukes et al.) disclose a process for the hydrogenation of distillates employing the noble metals platinum and palladium impregnated on zeolite Y. Distillates having a high aromatic concentration as well as a high concentration of heteroatoms (from 20 to 60 wt % aromatics, from about 10 ppm to about 0.9 wt % elemental sulfur, and from about 5 ppm to about 900 ppm nitrogen) may be treated in this process. There is no teaching, however, of alternating feeds of varying compositions over the same catalyst, as in the instant invention. There is also no teaching of the use of other catalysts in combination with noble metal catalysts, as in the instant invention.

SUMMARY OF THE INVENTION

The instant invention enables the refiner to use one catalyst batch in a single reaction zone such as one or more fixed bed reactors, for both the production of jet fuel as well as the production of low aromatic diesel. Although different feeds are used for the production of each distillate product, the same catalyst batch or catalyst system may be used for the production of both. The hydrodenitrogenation reaction and hydrodesulfurization reaction (for jet fuel production), as well as the hydrogenation reaction (for the production of low aromatic diesel) may occur in the same reaction zone. Pressures below 1000 psig are generally employed. A higher pressure maybe used; however, this invention can operate below 1000 psig, thereby reducing capital costs. One catalyst alone, such as a noble metal on a zeolite or amorphous alumina support, may be used. Alternately, a two catalyst system, wherein the feed is passed over a catalyst loaded with base metals before passing over a noble metal, is used. A two catalyst system is often preferred in order to reduce the aging rate of the noble metal catalyst. This two catalyst system is especially useful when desulfurizing (hydrotreating) cracked stocks. The noble metal catalyst is therefore protected from olefins and gums.

Product may be recycled to the feed stream. If recycle is employed, the ratio used is dependent upon the type of feed stream and type of catalyst system used. While processing high heteroatom feeds, such as light gas oil (LGO) or straight-run kerosene, there is essentially no aromatics saturation. The catalyst hydrogenation activity is reduced, presumably by adsorption of nitrogen and sulfur species. The catalyst is still stable and active for desulfurization. When a feed of low heteroatom content is once again used, such as hydrocracker splitter bottoms, the aromatics hydrogenation activity of the catalyst or catalyst system recovers, allowing the reactor temperature to be reduced while still making a product with no more than 10 wt % aromatics, preferably no more than 10 wt % aromatics. The instant invention employs, "block processing". The fixed bed reactor generally processes high heteroatom feeds for 5 to 20 days per month to produce jet fuel. The remaining days in the month (usually from 10 to 25 days) are used to produce low aromatic diesel from feeds with low heteromatom content.

DESCRIPTION OF THE FIGURES

FIG. 1(*b*) discloses the target conditions for the conversion of high heteroatom feed to jet fuel in a fixed bed reactor intended for block processing. FIG. 1(*c*) illustrates the loading of a fixed bed reactor for block processing when a two catalyst system is employed.

FIG. 3 demonstrates that catalyst activity is recovered more quickly if the catalyst is held at an elevated temperature for a period of about 48 hours before dropping to the reaction temperature. Low aromatics feed may be processed during this period. It is preferred that $H_2$ be passed alone over the catalyst, minimizing off specification product. It is theorized that the poisons are stripped from the noble metal when at high temperature, restoring its activity.

FIG. 4 illustrates the temperatures at which activity was restored for each block of hydrocracker feed processed over a dual catalyst system.

DETAILED DESCRIPTION OF THE INVENTION

Feedstock

Figure 1A:
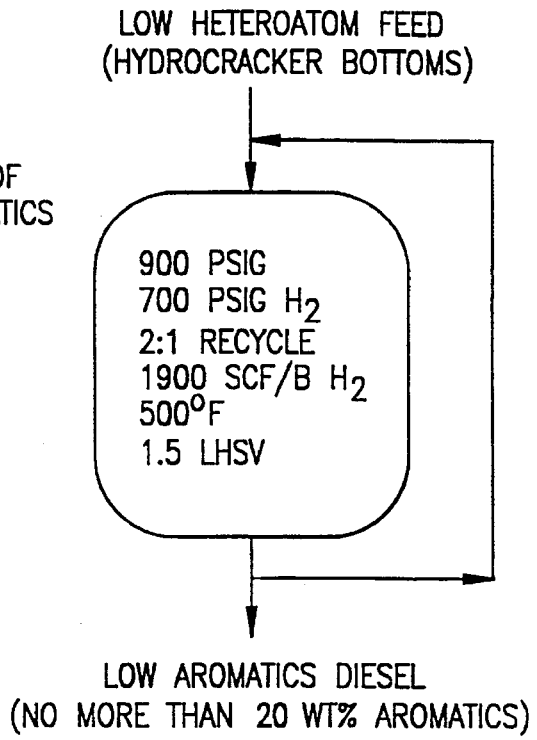
FIG. 1(*a*) illustrates the target conditions for conversion of low heteroatom feed to low aromatic diesel in a fixed bed reactor intended for block processing.

Since two different types of distillate products are produced in the instant invention over the same catalyst or catalyst system, two different types of feedstocks are used. High heteroatom feedstocks are used to produce jet fuels, and low heteroatom feedstocks are used to produce diesel with an aromatic content of below 20 wt %, preferably below 10 wt %. High heteroatom feedstocks typically have a sulfur content in the range from 5 to 10,000 ppm by weight, and a nitrogen content of between 45 and 200 ppm by weight. The activity of the catalysts preferred in the instant invention is more sensitive to the presence of nitrogen in feed than it is to the presence of sulfur. Low heteroatom feedstocks generally contain less than 500 ppm by weight of sulfur, and less than 0.25 ppm by weight of nitrogen.

Feeds used in the production of distillates and naphthas have relatively low endpoints since there is little need to convert higher boiling components. This is particularly the case when jet fuel is being produced. Feed boiling point characteristics are usually determined by the products required. The feedstocks employed in the instant invention are generally of petroleum origin, although feeds from synthetic oil production processes, such as Fischer-Tropsch synthesis or methanol conversion may be used. Feedstocks may also be obtained from the fractionation of shale oils and tar sands.

The feeds suitable for the production of jet fuel generally have an initial boiling point in the vicinity of 300° to 375° F. and an endpoint in the range from 440°to 750° F. The preferred boiling range is from about 340° F. to about 540° F. for jet fuel production. Straight-run kerosenes, direct from the crude distillation unit, are suitable for production of kerosene jet fuels as are catalytically cracked cycle oils. Kerosene jet fuels include Jet A, Jet A1, JP4 and JP8. Light gas oils may also be suitable. Cycle oils from catalytic cracking processes usually have boiling range of about 400° F. to 750° F., although LCO may have an endpoint as low as 600° F. Light gas oils have endpoints as low as 560° F. and work well in the process of this invention.

Low heteroatom feeds are required for the production of low aromatic content diesel in the process of this invention. A light cycle oil hydrocracking process is disclosed in U.S. Pat. No. 4,676,887, U.S. Pat. No. 4,738,766, and U.S. Pat. No. 4,789,457. In these processes, selective, partial, hydrogenation of bicyclic aromatics in LCO occurs. The primary object of these processes is the production of gasoline; however, an unconverted fraction (hydrocracker bottoms) remains. A portion of this unconverted material has a boiling range from about 415° F. to about 650° F. Hydrocracker bottoms are more paraffinic than the LCO feed due to the partial hydrogenation of aromatic. Furthermore, a considerable degree of desulfurization and denitrogenation has occurred due to the hydrodenitrogenation and hydrodesulfurization reactions that take place over the hydrotreating catalyst. It is a feed with low heteroatom content, suitable for the production of a diesel with an aromatic content of no more than 20 wt. %, preferably no more than 10 wt %. Low heteroatom distillate feeds can also be prepared by processing high heteroatom distillates in a catalytic hydrodesulfurization unit. Any hydrocracker distillate stock (not merely the bottoms) may be dearomatized in this invention.

Table 1 illustrates the properties of three feedstocks useful in the instant invention. Hydrocracker bottoms have a low heteroatom content and may be used in low aromatic diesel production. Hydrotreated light gas oil and straight-run kerosene are high heteroatom feeds and may be useful in the production of jet fuel. Table 1(a) discloses specifications for jet fuel. Table 1(b) discloses specifications for low aromatics diesel fuel.

TABLE 1

| | Feedstock Properties | | |
|---|---|---|---|
| Feed | Hydrocracker Splitter Btms | Straight Run Kero | Hydrotreated Light Gas Oil |
| API | 30.2 | 36.5 | 34.0 |
| Hydrogen wt % | 12.90 | 13.87 | 13.68 |
| Sulfur, ppm | <20 | 2800 | 110 |
| Nitrogen, ppm | <0.05 | 38 | 5 |
| Aromatics, wt % | 36.1 | 13.5 | 28.5 |
| IBP | 324 | 255 | 280 |
| 10% | 397 | 342 | 412 |
| 50% | 492 | 415 | 503 |
| 90% | 601 | 458 | 568 |
| EP | 711 | 494 | 608 |

TABLE 1(a)

| Jet Fuel Specifications | |
|---|---|
| Product | Reference Fuel Specifications |
| Color, Saybolt | |
| Visual | C/B (clear/bright) |
| Volatility | |
| Gravity @ 60° F., API, AVE | 37.0–51.0 |
| Combustion | |
| Aromatics (Vol %) | 25.0 max. |
| Olefins (Vol %) | 5.0 max. |
| Aniline Point (°F.) | |
| Smoke Point (mm) | 18.0 min. |
| Naphthalenes (vol %) | 3.0 max. |
| Corrosiveness | |
| Acidity, Total (mg KOH/g) | 0.1 max. |
| Corrosion, 2 hrs. @ 212° F. | 1 max. |
| Mercaptans (ppm) | 30 max. |
| Sulfur, Total (wt %) | 0.3 max./3000 ppm |
| Fluidity | |
| Freeze Point | –40 max. |
| Viscosity @ –20 C. | 8.0 max. |
| Stability | |
| JFTOT. Pressure Drop (mmHg) | 25 max. |
| Tube Deposit Number | 3 max. |
| Cleanliness & Purity | |
| Alkali Metals (ppm) | 1.0 max. |
| Existent Gum (mg/100 mi) | 7.0 max. |
| Haze Point (°F.) | 70 max. |
| Particulates (mg/gal) | 4.0 max. |
| Water Rxn:Vol Chg. (ml) | 2 max. |
| Interface Rating | 1 lb. |
| WSIM: Clear | 85 max. |
| Distillation IBP (°F.) | |
| 10% Recovered | 400 max. |
| 60% Recovered | 450 max. |
| End Point (°F.) | 572 max. |
| Residue (Vol %) | 1.5 max. |
| Flash Point (°F.) (TAG) | 100 min. |

TABLE 1(b)

| Specifications of Low Aromatics Diesel Fuel | |
|---|---|
| Property | |

TABLE 1(b)-continued

| Specifications of Low Aromatics Diesel Fuel | |
|---|---|
| Sulfur Content | 500 ppm max. |
| Aromatic Hydrogen Content wt % | 20 max. |
| Polycyclic Aromatic Hydrogen Content wt % | No Spec |
| Nitrogen Content, ppm | 10 max. |
| Natural Cetane No. | 40 |
| Gravity, API | 30–37 |
| Viscosity @ 40 C. cSt. | 1.9–4.1 |
| Flash Pt., °F. | 125 min. |
| Carbon Residue, wt % | 0.15 max. |
| Ash, wt % | 0.01 max. |
| Alkali Metals | 1 ppm |
| Distillation, °F. | |
| IBP | |
| 10% Rec. | 480 max. |
| 50% Rec. | |
| 90% Rec. | 540–640 |
| EP | 700 max. |

Catalysts

The process of this invention may be carried out over two different catalyst systems. In one case, the reaction zone, (usually a fixed bed reactor) is loaded with a supported catalyst comprised of a noble metal or metals, such as platinum or palladium. In an alternate case, a batch of supported catalyst comprising primarily nickel and molybdenum may be used in conjunction with the batch of supported noble metal catalyst in the reaction zone. Both the noble metals and the base metals provide a hydrogenation-dehydrogenation function. Noble metal catalysts, such as those comprising platinum or palladium or both, tend to be more vulnerable to aging than base metal catalysts. Using such catalysts in combination with a nickel/molybdenum catalyst such as that primarily used for hydrotreating or other hydroprocessing techniques can substantially slow the rate of aging of noble metal catalyst. The feed contacts the batch of catalyst comprising the base metal before it contacts the batch of catalyst comprising the noble metals. The ratio of the amount of base metal catalyst to noble metal catalyst is preferably 1:1. An effective range of ratios extends from 1:4 to 4:1. The ratio maybe varied to balance desulfurization with aromatic saturation.

The catalysts used in the instant invention are typically, heterogeneous, porous solid catalyst possessing hydrogenation-dehydrogenation functionality. Hydrogenation functionality is required to remove the heteroatoms present in a feed such as straight-run kerosene as well as to convert feed aromatics to naphthenes. If a high heteroatom feed is being processed in this invention there is little or no aromatic saturation. Because aromatic feed, such as hydrocracker bottoms, contains relatively bulky bicyclic and polycyclic components the catalysts must have a pore size which is sufficiently large to admit these materials to the interior structure of the catalyst where hydrodesulfurization, hydrodenitrogenation and aromatic saturations, involving ring-opening and hydrogenation reactions, can take place. A pore size of at least about 7.4 A (corresponding to the pore size of the large pore size zeolites X and Y) is sufficient for this purpose. Because, the end point of the feed is limited, the proportion of bulky, polynuclear aromatics is quite low. Very large pore sizes greatly exceeding those previously mentioned are not required. Crystalline zeolite catalysts which have a relatively limited pore size range, as compared to the so-called amorphous materials such as alumina or silica-alumina, titania and zirconia, may therefore be used to advantage in view of their activity and resistance to poisoning.

Crystalline aromatics hydrogenation catalysts, generally the zeolites, and, in particular, the large pore size zeolites having a Constraint Index less than 2 (see discussion below) can be used in the instant invention. For purposes of this invention, the term "zeolite" is meant to represent the class of metallosilicates, i.e., porous crystalline silicates, that contain silicon and oxygen atoms as the major components. Other components are also present, including aluminum, gallium, iron, boron, etc., with aluminum being preferred in order to obtain the requisite acidity. Minor components may be present separately, in mixtures in the catalyst or intrinsically in the structure of the catalyst.

A convenient measure of the extent to which a zeolite provides control to molecules of varying sizes to its internal structure is the Constraint Index of the zeolite. Zeolites which provide a highly restricted access to and egress from its internal structure have a high value for the Constraint Index, and zeolites of this kind usually have pores of small size, e.g., less than 5 Angstroms. On the other hand, zeolites which provide relatively free access to the internal zeolite structure have a low value for the Constraint Index and usually pores of large size, e.g., greater than 8 Angstroms. The method by which Constraint Index is determined is described fully in U.S. Pat. No. 4,016,218, to which reference is made for details of the method. A Constraint Index of less than 2 and preferably less than 1 is a characteristic of the hydroprocessing catalysts used in this invention.

Constraint Index (CI) values for some typical large pore materials are shown in Table 2 below:

TABLE 2

| | Constraint Index |
|---|---|
| | CI (Test Temperature) |
| ZSM-4 | 0.5 (316° C.) (608° F.) |
| ZSM-20 | 0.5 (371° C.) (700° F.) |
| TEA Mordenite | 0.4 (316° C.) (608° F.) |
| Mordenite | 0.5 (316° C.) (608° F.) |
| REY | 0.4 (316° C.) (608° F.) |
| Amorphous Silica-Alumina | 0.6 (538° C.) (608° F.) |
| Dealuminized Y (Deal Y) | 0.5 (510° C.) (950° F.) |
| Zeolite Beta | 0.6–2 (316°–399° C.) (601–750° F.) |

The nature of the CI parameter and the technique by which it is determined suggest the possibility that a given zeolite can be tested under somewhat different conditions and thereby exhibit different Constraint Indices. Constraint Index may vary with severity of operation (conversion) and the presence or absence of binders. Other variables, such as crystal size of the zeolite, the presence of occluded contaminants, etc., may also affect the Constraint Index. It may be possible to so select test conditions, e.g., temperatures, as to establish more than one value for the Constraint Index of a particular zeolite, as with zeolite beta. A zeolite is considered to have a Constraint Index within the specified range if it can be brought into the range under varying conditions.

The large pore zeolites, i.e., those zeolites having a Constraint Index less than 2 have a pore size sufficiently large to admit the vast majority of components normally found in the feeds. These zeolites are generally stated to have a pore size in excess of 7 Angstroms and are represented by zeolites having the structure of, e.g., Zeolite Beta, Zeolite X, Zeolite Y, faujasite, Ultrastable Y (USY), Dealuminized Y (Deal Y), Mordenite, ZSM-3, ZSM-4, ZSM-18 and ZSM-20. Zeolite ZSM-20 resembles faujasite in certain aspects of structure, but has a notably higher silica/alumina ratio than faujasite, as do the various forms of zeolite Y, especially USY and De-AlY. Zeolite Y is the preferred catalyst, and it is preferably used in one of its more stable forms, especially USY or De-AlY.

Although Zeolite Beta has a Constraint Index less than 2, it does not behave exactly like a typical large pore zeolite. Zeolite Beta satisfies the pore size requirements for a hydrocracking catalyst for use in the present process but it is not preferred because of its paraffin-selective behavior. Amorphous aromatics hydrogenation catalysts such as noble metals supported on alumina and silica-alumina may also be used.

Zeolite ZSM-4 is described in U.S. Pat. No. 3,923,639; Zeolite ZSM-20 in U.S. Pat. No. 3,972,983; Zeolite Beta in U.S. Pat. Nos. 3,308,069 and Re. 28,341; Low sodium Ultrastable Y molecular sieve (USY) is described in U.S. Pat. Nos. 3,293,192 and 3,449,070; Dealuminized Y zeolite (Deal Y) may be prepared by the method found in U.S. Pat. No. 3,442,795; and Zeolite UHP-Y is described in U.S. Pat. No. 4,401,556. Reference is made to these patents for details of these zeolite catalysts.

Catalyst stability during the extended cycle life is essential and this may be conferred by suitable choice of catalyst structure and composition, especially silica:alumina ratio. This ratio may be varied by initial zeolite synthesis conditions, or by subsequent dealuminization as by steaming or by substitution of frame work aluminum with other trivalent species such as boron, iron or gallium. Because of its convenience, steaming is a preferred treatment. In order to secure satisfactory catalyst stability, high silica:alumina ratios, e.g. over 20:1 are preferred. These may be attained by steaming.

Zeolites with a silica-to-alumina mole ratio of at least 3:1 are useful, for example, zeolite Y. It is preferred to use zeolites having much higher silica-to-alumina mole ratios, i.e., ratios of at least 20:1, as in zeolite USY. The silica-to-alumina mole ratio referred to may be determined by conventional analysis. This ratio is meant to represent, as closely as possible, the ratio in the rigid anionic framework of the zeolite crystal and to exclude aluminum in the binder or in cationic or other forms within the channels.

The hydroprocessing catalysts of this invention contain metals to provide hydrogenation-dehydrogenation functionality. Metals for hydrogenation dehydrogenation can be exchanged or impregnated into the composition, using a suitable compound of the metal. As indicated previously, a catalyst loaded with noble metals must be present. Noble metals, found in Group VIII of the Periodic Table, include platinum, palladium, iridium, and rhenium. A noble metal or metals is present in an amount ranging from 0.1 to 5 wt %, preferably from 0.3 to 3 wt %. Catalysts loaded with base metals from Groups VB, VIB, or VIIIB of the IUPAC Periodic Table, e.g. nickel, cobalt, molybdenum, vanadium, tungsten may be mixed with the catalyst loaded with a noble metal or metals. Combinations of a Group VB or Group VIB metal or metals with a Group VIII are especially favored, such as Ni—W, Co—Mo, Ni—V, NiMo. Base metals may be present on the catalyst in a range from 5 to 20 wt %.

Hydroprocessing Conditions

Figure 1B:
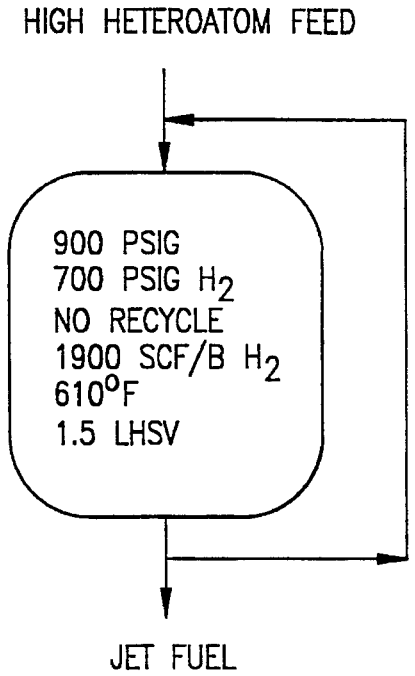
Figure 1C:
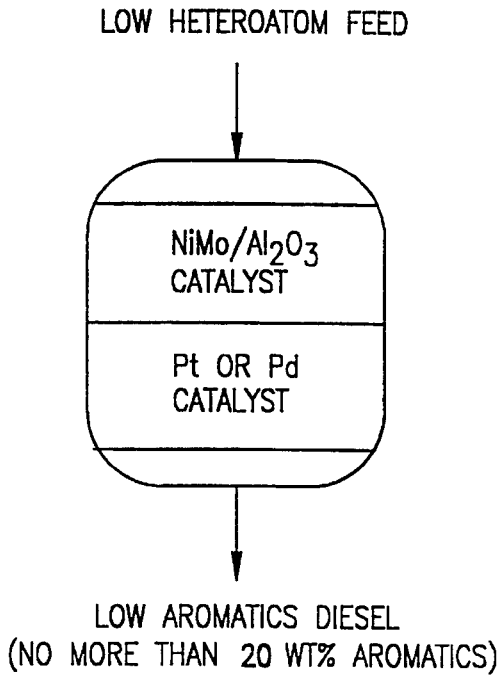

FIGS. 1(*a*), 1(*b*) and 1(*c*) (attached) illustrate three different situations under which the fixed bed reactor of the instant invention may be operated. FIG. 1(*a*) illustrates the target conditions for the conversion of low heteroatom feed to low aromatics diesel in a fixed bed reactor loaded only with a noble metal catalyst comprising platinum or palladium. These conditions are 900 psig pressure, 700 psig $H_2$ inlet pressure, 500° F., 0.1 to 10, and 1900 SCFB $H_2$. A recycle ratio of 2:1 is employed. The volume of fixed bed effluent recycled to the reactor is twice that of the new feed added, under steady state conditions.

FIG. 1(*a*) illustrates target conditions; however, acceptable ranges of appropriate conditions exist. Suitable pressures range from about 500 to about 1000 psig, and hydrogen inlet pressure may extend from about 350 to about 800 psig. Appropriate reaction temperatures extend from about 340° to about 650° F. Space velocity may vary from about 0.5 to about 0.1 to 10 LHSV. Once-through hydrogen circulation may extend from about 1000 SCF/B to about 10,000 SCF/B. Recycling is necessary with a low heteroatom feed but not a high heteroatom feed. Hydrogenation is an exothermic reaction which consumes minimal amounts of hydrogen. Recycle is used to control the temperature rise across the catalyst bed. The appropriate range of recycle ratios is from 0.5:1 to 10:1.

FIG. 1(*b*) illustrates the target conditions for conversion of high heteroatom feed to jet fuel in a fixed bed reactor. In this situation there is no product recycle. The target pressure is 900 psig, and the hydrogen inlet pressure is 700 psig. The target temperature is 610° F., space velocity is 0.1 to 10 LHSV, and the once-through hydrogen circulation is 1900 SCFB $H_2$. The acceptable ranges for conditions in the situation depicted by FIG. 1(*b*) are the same as the ranges of FIG. 1(*a*) except for the recycle ratio. The pressure is in a range from about 500 to about 1000 psig, the hydrogen inlet pressure is in a range from about 350 to about 800 psig $H_2$. The temperature may range from 500° F. to 800° F. The space velocity is from 0.1 to 10 LHSV, and the hydrogen circulation is from about 1000 SCF/B to 10,000 SCF/B.

FIG. 1(*c*) illustrates the loading of a fixed bed reactor for block processing with a two catalyst system. In the instant invention, a dual catalyst system has several advantages. High heteroatom feeds may continue to be processed, producing jet fuel, even if the noble metal catalyst is completely deactivated. The hydrotreating catalyst containing base metals converts organic nitrogen to ammonia and sulfur to $H_2S$, thereby improving the stability of the noble metal catalyst. The catalyst loaded with base metals tends to hydrogenate coke precursors, thereby improving the stability of the noble metal catalyst. Furthermore, the catalyst loaded with base metals protects the noble metal catalyst from contamination in the event of unit upsets.

In the preferred case, equal volumes of a catalyst loaded with noble metals and a catalyst loaded with base metals such as nickel and molybdenum (such as that usually used in hydrotreating) are placed in the fixed bed reactor. Although a ratio of 1:1 is preferred, a range of ratios from 1:4 to 4:1 is acceptable. The catalyst loaded with noble metals is poured into the reactor first, then the catalyst loaded with base metals is added on top of the first catalyst. Two fixed bed reactors may also be used in this embodiment, as disclosed in Example 3. Each of the catalysts may be in a separate reactor, and the reactors may be connected in series. It is critical for the NiMo catalyst to be the first catalyst over which the feed passes, since the purpose of using two catalysts at once is the retardance of poisoning of the noble metal catalyst while using a lower hydrogen circulation rate, resulting in a less expensive procedure than that involving the use of a noble metal catalyst alone. The suitable ranges of conditions for block processing over a two catalyst system are the same as those used in the single catalyst situations previously illustrated. The pressure is in the range from about 500 to about 1000 psig. The hydrogen inlet pressure ranges from about 350 to about 800 psig $H_2$, preferably 700 psig. The reaction temperature may range from 500° to 800° F. The space velocity is from about 0.1 to 10 LHSV, preferably 1.5 LHSV. The hydrogen circulation may range from 1600 to 10,000 SCF/B, preferably 1900 SCF/B.

The monthly schedule below is suggested if block processing is employed over a catalyst comprising noble metals. This schedule can be altered, however, to meet production demand.

1. Low heteroatom feed is converted to low aromatic diesel (less than 2 wt %) for 10 to 25 days, preferably 16 to 24 days.
2. At the end of the run of low heteroatom feed, a switch to high heteroatom feed is made. This run lasts from 5 to 20 days, preferably from 7 to 14 days. During the switch from low heteroatom feed to high heteroatom feed, the temperature is raised gradually from about 500° F. to about 620° F. over a period of about 12 hours.
3. At the conclusion of the run of high heteroatom feed, a switch is made to low heteroatom feed and the temperature is lowered to 550° F. Temperature is then gradually lowered to 500° F. as catalyst activity returns. The recovery of catalyst hydrogenation activity is dependent upon the reactor or reactors used and methods of feed handling employed. It is desirable to use a fixed bed reactor with minimal dead volume. It is also desirable to minimize feed backmixing, due to the high sensitivity of the catalyst to nitrogen in the feed. Feed backmixing can be minimized by delivering each feedstock from a separate charge system. Line-flushing is thus eliminated as a potential detriment to catalyst activity.

The following examples are illustrative only and are in no way intended to be limiting:

EXAMPLES

Example 1

Example 1 illustrates block processing of high heteroatom and low heteroatom feeds over a noble metal catalyst. Table 3 provides a feedstock and product comparison for a low heteroatom feed, hydrocracker bottoms, and a high heteroatom feed, straight-run kerosene. The products were produced using the instant invention. The specifications for Jet Fuel and Low Aromatics Diesel Fuel were provided in Tables 1(a) and 1(b) respectively. The Straight Run Kerosene Product of Table 3 meets the requirements of Table 1(a) for Jet Fuel except for color and WISM (a light dispersion test). The criteria of Table 1(a) maybe met by the addition of antioxidants. Table 1(a) provides the minimum smoke point for jet fuels, 18 mm. The maximum aromatics content for jet fuels at a smoke point of 18 mm is 25 vol %. If the aromatics content is below 25 vol. %, the smoke point will be below 18 mm. Smoke point is more difficult to measure than aromatics content so this correlation is frequently used. The product using hydrocracker bottoms feed falls within the limits of Table 1(b), Low Aromatics Diesel.

TABLE 3

| Feedstock and Product Properties | | | | |
|---|---|---|---|---|
| Feed | Hydro-cracker Bottoms | Product Hydro-cracker Bottoms Feed | Srun Kero | Product of Straight Run Kerosene Feed |
| API | 30.2 | 33.3 | 36.6 | 36.9 |
| Hydrogen wt % | 12.90 | 13.65 | 13.70 | 13.75 |
| Sulfur, ppmw | <20 | <20 | 2800 | 1300–1800 |
| Nitrogen, ppmw | <0.05 | <0.05 | 56 | 30–40 |
| Aromatics, wt % (correlates directly w/smoke point) | 36.1 | 9.1 | 13.5 | 13.3 |
| Cetane Index | 36.6 | 41.8 | 33.2 | 33.9 |
| Yield, wt %* | — | 98 | — | 99 |
| CN | 34 | 38 | N/A | N/A |
| Wt % Polycyclic Aromatics | 5 | 1 | N/A | N/A |
| Color | Clear Green Tint | Clear White | Cloudy Green/ Black | Clear White |
| WSIM (light dispersion test) | N/A | N/A | 0 | 95 |
| Distillation °F. | | | | |
| IBP | 414 | 400 | 378 | 375 |
| 10% | 442 | 433 | 393 | 392 |
| 50% | 488 | 480 | 406 | 407 |
| 90% | 583 | 570 | 422 | 424 |
| EP | 643 | 628 | 445 | 446 |

*Conversion to material boiling beneath the feedstock IPB is <3 wt % in each block.
N/A Not Applicable Table 1 (reproduced below) discloses the characteristics of another high heteroatom feed, hydrotreated light gas oil. In this example a hydrocracker bottoms feed was processed over a catalyst comprising 0.3 wt % of platinum and 0.3 wt % of palladium. These noble metals were loaded onto a neutralized USY zeolite which comprises about 25 wt % alumina. The surface area of the catalyst is in the range from 150 to 300 $m^2/g$. The product resulting from the hydrocracker bottoms feed is a diesel fuel containing less than 10 wt % aromatic. In separate blocks over the same catalyst, both straight-run kerosene and hydrotreated light gas oil were separately treated to produce jet fuel.

TABLE 1

| Feedstock Properties | | | |
|---|---|---|---|
| Feed | Hydrocracker Splitter Btms | Straight Run Kero | Hydrotreated Light Gas Oil |
| API | 30.2 | 6.5 | 34.0 |
| Hydrogen wt % | 12.90 | 13.87 | 13.68 |
| Sulfur, ppm | <20 | 2800 | 110 |
| Nitrogen, ppm | <0.05 | 38 | 5 |
| Aromatics, wt % | 36.1 | 13.5 | 28.5 |
| IBP | 324 | 255 | 280 |
| 10% | 397 | 342 | 412 |
| 50% | 492 | 415 | 503 |
| 90% | 601 | 458 | 568 |
| EP | 711 | 494 | 608 |

Experiments were carried out in a fixed-bed pilot unit employing the commercial noble-metal based hydroprocessing catalyst described above. Approximately 20 cc of catalyst, sized to 20–30 mesh was loaded in a reactor. The reaction conditions were temperatures of 340°–600° F., 0.1 to 10 LHSV, 2500 SCF/B of once-through hydrogen circulation, and hydrogen inlet pressure of about 600 psia. When feed with a high heteroatom content (kerosene usually contains 2700 ppm sulfur and 45 ppm nitrogen LGO usually contains 110 ppm nitrogen) is being processed, there is essentially no aromatic saturation. The catalyst hydrogenation activity is reduced, presumably by adsorption of nitrogen and sulfur species. The catalyst is still stable and active for desulfurization, however. When the feed is switched back to hydrocracker splitter bottoms, the aromatic hydrogenation activity of the catalyst recovers, allowing reduction of the reactor temperature while still making a product containing no more than 20 wt % aromatics, preferably no more than 10 wt % aromatics.

Figure 2:
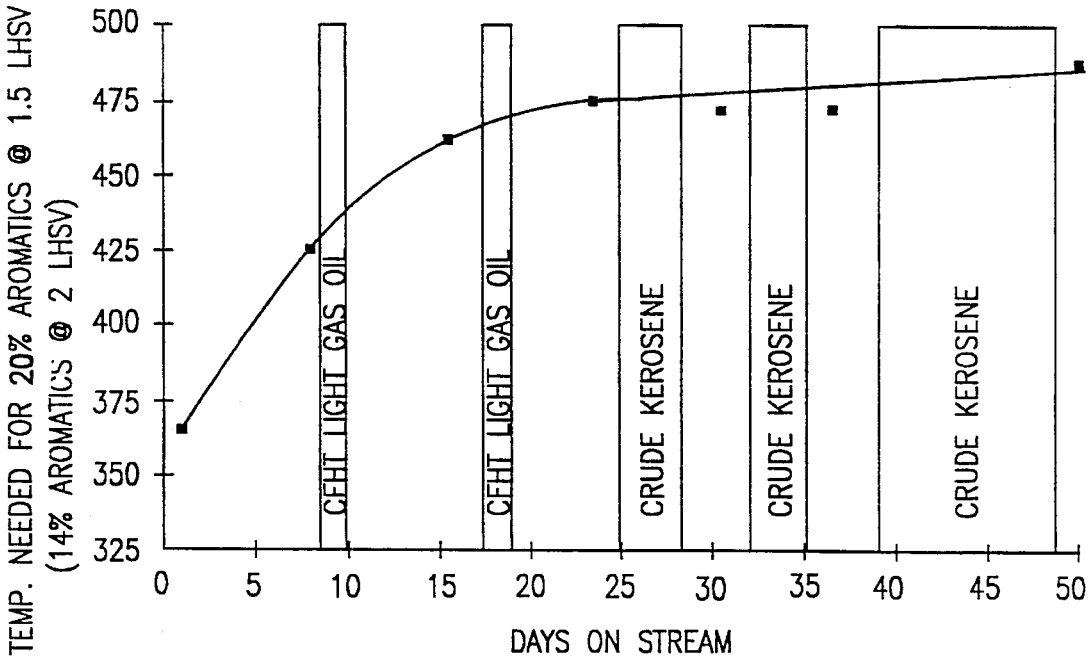
FIG. 2 shows that the temperature required for a noble metal catalyst to make a product containing no more than 10 wt % aromatic leveled off ("lined out") at 460° F. even after processing several blocks of high heteroatom content sulfur and nitrogen feeds.

FIG. 2 illustrates data on block operation. The temperature needed to produce a diesel fuel containing no more than 20 wt % aromatic (preferably no more than 10 wt % aromatics) at 0.1 to 10 LHSV, or a jet fuel containing no more than 14 wt % aromatic at 0.1 to 10 LHSV is plotted against the days on stream of the catalyst. Low heteroatom feed was processed on the days between the blocks containing light gas oil or kerosene. FIG. 2 shows that the temperature required to make a product containing no more than 2 wt % aromatic leveled off at 460° F. even after processing several blocks of high heteroatom content sulfur and nitrogen feeds. Catalyst life is generally projected to be about one year, therefore catalyst batches should be changed yearly.

Example 2

Example 2 demonstrates how noble metal catalyst activity is restored after processing a feed of high heteroatom content. Catalyst activity is reduced by processing a feed that contains significant heteroatom content. Switching back to a low heteroatom feed restores catalyst activity. Holding the catalyst or catalyst system at elevated temperatures allows activity to be restored more quickly.

This is illustrated in FIG. 3. The normalized temperature required to reduce product aromatic to no more than 2 wt % is plotted against the days the catalyst has been on stream. The actual unit temperature for this series of points was either 500° F. or 600° F. The plot has been broken up into three segments. In the first and last segments, the actual unit temperature was at 500° F. The nearly vertical segment represents a 48 hour period during which the unit was held at 600° F. The line is nearly vertical because catalyst activity recovery was unexpectedly accelerated by the 600° F. treatment. In the first segment, the activity was recovering at less than 1° F. per day. During the 600° F. treatment the catalyst activity recovered at over 15° F. per day. During the final period at 500° F. the catalyst activity was stable suggesting that no more activity recovery is possible(at that point the catalyst is "lined out").

Example 3

Example 3 illustrates block processing of high and low heteroatom feeds over a dual catalyst system at a relatively low hydrogen circulation rate. The same hydrocracker bottoms and straight-run kerosene used in Example 1 were block processed over a catalyst system containing equal volumes of a catalyst loaded with nickel and molybdenum (4 wt % Ni, 25 wt % Mo, 166 $m^2/g$) and a catalyst loaded with noble metals, specifically Pt and Pd as described in Example 1. Both catalysts are frequently used in hydroprocessing procedures, specifically hydrotreating.

The experiments of Example 3 were conducted in a fixed bed pilot unit having two fixed bed reactors. The Ni-Mo catalyst was placed in the first reactor and the noble metal catalyst was placed in the second reactor. Approximately 75 cc of each catalyst were loaded. The reaction conditions were temperatures of 340°–600° F., 0.1 to 10 LHSV and a hydrogen circulation rate of 1900 SCF/B (as opposed to 2500 SCF/B in Example 1) and hydrogen inlet pressure of 600 psia.

In Example 3 the kerosene was run in 10 day blocks and the hydrocracker bottoms feed was processed in 20 day blocks. FIG. 4 illustrates the temperatures at which activity was restored for each block of hydrocracker feed processed. As the catalyst aged, the "line-out" temperature increased slightly with each block of hydrocracker bottoms run. FIG. 4 may be compared with FIG. 2, which used only a noble catalyst rather than dual catalyst system. In FIG. 4, the"line-out" temperature increased slightly with each hydrocracker bottoms block run, but did not exceed 500° F. In FIG. 2, the "line-out" temperature did not appear to increase significantly at all with the number of hydrocracker feed blocks processed. Furthermore, a lower hydrogen circulation rate was employed than in FIG. 2. Comparison of Examples 1 and 3 and FIGS. 2 and 4 seems to suggest that a dual catalyst system is less expensive to employ than the single catalyst approach of Example 1, provided slight increases in "line-out" temperature are acceptable. Catalyst loaded with nickel and molybdenum is less expensive than catalyst loaded with noble metals. Furthermore, operation at a low hydrogen circulation rate is also desirable from an economic standpoint. The stabilization of catalyst at low hydrogen circulation rates using low heteroatom (less than 1 ppm each of N and S) feeds is unexpected.

What is claimed is:

1. A process for the upgrading of distillate feeds in which a batch of supported hydroprocessing catalyst is placed in a reaction zone, the catalyst comprising an effective amount of a noble metal or metals and having a specific activity for aromatics hydrogenation, wherein diesel product comprising a low amount of aromatic compounds is produced from a feed comprising a low amount of heteroatoms wherein the feedback having a low heteratom content comprises less than about 500 ppm by weight sulfur and less than about 25 ppm by weight nitrogen, and a jet fuel product is produced from a feed comprising a relatively high amount of heteroatoms wherein the feedstock having a relatively high heteratom content comprises from about 5 to about 10,000 ppm by weight sulfur and from about 45 ppm to about 200 ppm by weight nitrogen, each product being produced in a separate block in the same reaction zone over the same batch of catalyst, the aromatics hydrogenation activity of the catalyst batch being poisoned each time the feed is switched from the feed low in heteroatoms to the feed relatively high in heteroatoms, wherein the aromatics hydrogenation activity of the catalyst is restored each time the feed is switched from relatively high heteroatom feed to low heteroatom feed, the process comprising the following steps:

(a) producing a low aromatic diesel from a feed comprising a low heteroatom content, over a batch of catalyst which comprises a noble metal or metals for a specific number of days under specific conditions;

(b) switching from a feed with a low heteroatom content to a feed with a relatively high heteroatom content, thereby producing a distillate with reduced nitrogen or sulfur content for a specific number of days over the same batch of catalyst used in step (a), under specific conditions;

(c) switching from a feed with relatively high heteroatom content to a feed with low heteroatom content, thereby repeating step (a);

(d) repeating steps (b) and (c) until the catalyst batch is replaced.

2. The process of claim 1, wherein the reaction zone comprises one or more fixed bed reactors.

3. The process of claim 1, wherein the hydroprocessing catalyst comprises at least one noble metal, wherein the total noble metal content is in a range from 0.1 to 5 wt %.

4. The process of claim 3, wherein the noble metal or metals are selected from a group consisting of platinum, palladium, iridium, and rhenium.

5. The process of claim 1, wherein the catalyst support is selected from the group consisting of ZSM-4, ZSM-20, TEA Mordenite, Mordenite, REY, alumina, silica, dealuminized Y, and zeolite beta, titania and zirconia.

6. The process of claim 1, wherein the diesel product comprising a low amount of aromatic comprises no more than 20 wt % aromatic.

7. The process of claim 6, wherein the diesel product comprising a low amount of aromatic comprises no more than 10 wt % aromatics.

8. The process of claim 1 wherein each feed employed is delivered by a separate charge system in order to minimize feed backmixing.

9. The process of claim 1, wherein the length of step (a) is in a range from about 10 days to about 25 days.

10. The process of claim 1, wherein the length of step (b) is in a range from about 5 days to about 20 days.

11. The process of claim 1, wherein the conditions of step (a) comprise a pressure in the range from about 500 to about 1000 psig, a hydrogen inlet pressure in the range from about 350 to about 800 psig, a reaction temperature in the range from about 350° F. to about 650° F., a space velocity in a range from about 0.1 to 10 LHSV, a once-through hydrogen circulation rate which extends from about 1000 SCF/B to about 10,000 SCF/B, and a recycle ratio in the range from 0.5 to 10.

12. The process of claim 1, wherein the conditions of step (b) comprise a pressure in the range from about 500 to about 1000 psig, a hydrogen inlet pressure in the range from about 350 to about 800 psig, a reaction temperature in the range from about 500° F. to about 800° F., a space velocity which is in a range from about 0.1 to about 10 LHSV, and a once-through hydrogen circulation rate which extends from about 1000 SCF/B to about 10,000 SCF/B.

13. The process of claim 1, step (c), wherein the temperature of the reaction zone is held at a temperature greater than the reaction temperature for a specific period in order to regain catalyst activity more quickly, prior to being decreased to reaction temperature.

14. The process of claim 12, wherein the temperature of the reaction zone is held at about a temperature from 550° F. to about 700° F. for 48 hours, in order to restore catalyst activity more quickly, prior to being decreased to the reaction temperature of about 500° F.

15. A process for the upgrading of distillate feeds in which a dual catalyst system is used, the dual catalyst system comprising two batches of different supported hydroprocessing catalysts which are placed in the same reaction zone but are not mixed, the first hydroprocessing catalyst comprising an effective amount of at least one base metal and having a specific activity as expressed by its alpha value, the second hydroprocessing catalyst comprising an effective amount of at least one noble metal, the first and second catalysts being present in a ratio of 1:4 to 4:1 wherein diesel product comprising a low amount of aromatic is produced from a feed comprising a low amount of heteroatoms wherein the feedstock having a low heteratom content comprises less than about 500 ppm by weight sulfur and less than about 25 ppm by weight nitrogen, and a jet fuel product from a feed comprising a relatively high amount of heteroatoms wherein the feedstock having a relatively high heteratom content comprises from about 5 to about 10,000 ppm by weight sulfur and from about 45 ppm to about 200 ppm by weight nitrogen, each product being produced in a separate block in the same reaction zone over the same catalyst system, the activity of each batch in the catalyst system being restored each time the feed is switched, the process comprising the following steps:

(a) producing a low aromatics diesel from a feed comprising a low heteroatom content, over a dual catalyst system for a specific number of days under specific conditions;

(b) switching from a feed with a low heteroatom content to a feed with a relatively high heteroatom content, thereby producing distillate with reduced nitrogen and sulfur content for a specific number of days over the same catalyst system used in step (a), under specific conditions:

(c) switching from a feed with relatively high heteroatom content to a feed with low heteroatom content, thereby repeating step (a):

(d) repeating steps (b) and (c) until both the batches of the catalyst system are replaced.

16. The process of claim 15, wherein the reaction zone comprises one or more fixed bed reactors.

17. The process of claim 16, wherein two reactors in series comprise the reaction zone, the first reactor containing a batch of the hydroprocessing catalyst which comprises at least one base metal and the second reactor comprising a batch of the hydroprocessing catalyst which comprises at least one noble metal.

18. The process of claim 15, wherein the total base metal content of the first hydroprocessing catalyst is in the range from about 5 to about 20 wt %, and the total noble metal content of the second hydroprocessing catalyst is in a range from about 0.1 to about 5 wt %.

19. The process of claim 15, wherein the base metal or metals of the first hydroprocessing catalyst are selected from the group consisting of nickel, cobalt, molybdenum, vanadium, and tungsten, and the noble metal or metals of the second hydroprocessing catalyst are selected from the group consisting of platinum, palladium, iridium and rhenium and mixtures thereof.

20. The process of claim 15, wherein the catalyst support of each hydroprocessing catalyst of the dual catalyst system is selected from alumina, ZSM-4, ZSM-20, TEA Mordenite, Mordenite, REY, Amorphous silica-alumina, dealuminized Y, and zeolite beta, silica, titania and zirconia.

21. The process of claim 15, wherein the diesel product comprising a low amount of aromatic comprises no more than 20 wt % aromatic.

22. The process of claim 21, wherein the diesel product comprising a low amount of aromatic comprises no more than 10 wt % aromatics.

23. The process of claim 15, wherein each feed employed is delivered by a separate charge system in order to minimize feed backmixing.

24. The process of claim 15, wherein the length of step (a) is in a range from about 16 days to about 24 days, and the length of step (b) is in a range from about 7 days to about 14 days.

25. The process of claim 15, wherein the conditions of step (a) comprise a pressure in the range from about 500 to about 1000 psig, a hydrogen inlet pressure in the range from about 350 to about 800 psig, a reaction temperature in the range from about 350° F. to about 650° F., a space velocity in a range from about 0.1 to about 10 LHSV, a once-through hydrogen circulation rate which extends from about 1000 SCF/B to about 5000 SCF/B, and a recycle ratio in the range from 0.5 to 10.

26. The process of claim 15, wherein the conditions of step (b) comprise a pressure in the range from about 500 to about 1000 psig, a hydrogen inlet pressure in the range from about 350 to about 800 psig, a reaction temperature in the range from about 500° F. to about 800° F., a space velocity which is in a range from about 0.1 to about 10 LHSV, and a once-through hydrogen circulation rate which extends from about 1000 SCF/B to about 10,000 SCF/B.

* * * * *

UNITED STATES PATENT AND TRADEMARK OFFICE

CERTIFICATE OF CORRECTION

PATENT NO. : 5,520,799

DATED : May 28, 1996

INVENTOR(S) : Stephen H. Brown, et al.

It is certified that error appears in the above-indentified patent and that said Letters Patent is hereby corrected as shown below:

Col. 5, line 66 to Col. 6, line 5 - Table 1(b) split between columns

Col. 13, line 39: "feedback" should read -- feedstock --.

Signed and Sealed this

Eighth Day of October, 1996

Bruce Lehman

*Attest:*

BRUCE LEHMAN

*Attesting Officer*

*Commissioner of Patents and Trademarks*